US009247793B2

(12) United States Patent
Hidde et al.

(10) Patent No.: US 9,247,793 B2
(45) Date of Patent: Feb. 2, 2016

(54) COMPACT UMBRELLA WITH CAN-SHAPED HANDLE

(71) Applicant: SILAG Handel AG, Langenfeld/Rhld. (DE)

(72) Inventors: Axel R. Hidde, Siegen (DE); Odo Klose, Wuppertal (DE)

( * ) Notice: Subject to any disclaimer, the term of this patent is extended or adjusted under 35 U.S.C. 154(b) by 0 days.

(21) Appl. No.: 14/221,035

(22) Filed: Mar. 20, 2014

(65) Prior Publication Data

US 2014/0202506 A1 Jul. 24, 2014

(30) Foreign Application Priority Data

Jan. 21, 2013 (DE) ..... 20 2013 000 510.6

(51) Int. Cl.
*A45B 25/00* (2006.01)
*A45B 19/00* (2006.01)
*A45B 25/24* (2006.01)

(52) U.S. Cl.
CPC ..... *A45B 25/00* (2013.01); *A45B 25/24* (2013.01); *A45B 2019/002* (2013.01); *A45B 2200/1081* (2013.01)

(58) Field of Classification Search
CPC ..... A45B 25/24; A45B 2019/002; A45B 2200/1081; A45B 25/28
USPC ..... 135/25.41, 34.2, 25.1
See application file for complete search history.

(56) References Cited

U.S. PATENT DOCUMENTS

| | | | | |
|---|---|---|---|---|
| 868,326 | A | 10/1907 | Casale | |
| 892,813 | A | 7/1908 | Dolles | |
| 1,455,605 | A * | 5/1923 | Davis | 135/25.31 |
| 2,091,676 | A | 8/1937 | Fliegner | |
| 2,164,242 | A * | 6/1939 | Henry | 135/34.2 |
| 2,172,549 | A * | 9/1939 | Solomon | 135/20.2 |
| 4,456,023 | A * | 6/1984 | Fujihashi | 135/25.41 |
| 6,223,759 | B1 * | 5/2001 | Flippin, Jr. | 135/34.2 |
| 6,334,454 | B1 * | 1/2002 | Williams | 135/25.41 |
| 8,156,951 | B2 | 4/2012 | Klose | |
| 8,453,660 | B2 | 6/2013 | Herriger et al. | |
| 2003/0094189 | A1 * | 5/2003 | Ko | 135/16 |
| 2005/0098199 | A1 * | 5/2005 | Ko | 135/25.1 |
| 2005/0166949 | A1 * | 8/2005 | Ko | 135/25.41 |

FOREIGN PATENT DOCUMENTS

| | | |
|---|---|---|
| CN | 2002-291509 | 10/2002 |
| DE | 618 174 | 8/1935 |
| DE | 625 783 | 1/1936 |
| DE | 1 814 204 | 9/1970 |
| DE | 2 137 261 | 2/1973 |
| DE | 2 307 706 | 8/1973 |
| DE | 91 00 505 | 5/1991 |
| DE | 40 08 212 | 9/1991 |
| DE | 91 15 108 | 4/1992 |
| DE | 43 14 650 | 11/1994 |
| DE | 195 05 707 | 3/1996 |
| DE | 195 25 409 | 7/1996 |

(Continued)

*Primary Examiner* — Noah Chandler Hawk

(74) *Attorney, Agent, or Firm* — Henry M. Feiereisen LLC.

(57) ABSTRACT

A compact umbrella has a hollow-cylindrical body forming a shell, wherein the shell is made of a solid material and is configured to accommodate the umbrella in a transport state of the umbrella, when the umbrella is closed and folded, as a protective umbrella shell and is further configured to operate in an operating position of the umbrella, when opened, as a handle shell or carrying handle.

8 Claims, 9 Drawing Sheets

(56) References Cited

FOREIGN PATENT DOCUMENTS

| | | |
|---|---|---|
| DE | 102 17 280 | 6/2003 |
| DE | 102 53 797 | 5/2004 |
| DE | 202007012276 | 12/2007 |
| DE | 202011003388 | 6/2011 |
| EP | 0 495 472 | 7/1992 |
| EP | 2 494 883 | 9/2012 |
| GB | 311265 | 8/1929 |
| WO | WO 97/48303 | 12/1997 |
| WO | WO 2009/039939 | 4/2009 |

* cited by examiner

COMPACT UMBRELLA WITH CAN-SHAPED HANDLE

CROSS-REFERENCES TO RELATED APPLICATIONS

This application claims the priority of German Utility Model Application, Serial No. 20 2013 000 510 U1, filed Jan. 21, 2013, pursuant to 35 U.S.C. 119(*a*)-(*d*), the content of which is incorporated herein by reference in its entirety as if fully set forth herein.

BACKGROUND OF THE INVENTION

The present invention relates to a compact, in particular foldable and collapsible umbrella.

Due to the long history of umbrellas, an extensive and diverse collection of appropriate property rights literature has accumulated. Everything relating to a shell and folding was developed specific for the application under the keyword 'collapsible umbrella' or 'collapsible umbrella'. Thus, there is the following wide-ranging field of corresponding exemplary applications

- collapsible umbrella with reinforced canopy frame
- fully automatic collapsible umbrella
- automatic umbrella
- folding laundry umbrella
- portable canopy for events
- wind-resistant collapsible umbrella
- easy-to-open and collapsible umbrella with reduced volume
- collapsible umbrella with map
- suspension for a collapsible umbrella
- chair with holder and umbrella
- insect protection umbrella
- bicycle with holder and umbrella
- holder with foldable sunshade
- holder and umbrella strollers
- holder and umbrella for animals
- canopying equipment
- foldable and extendible transport means
- collapsible baby carriage
- collapsible umbrella as a broadband antenna.

It would be desirable and advantageous to obviate prior art shortcomings and to provide an improved collapsible umbrella with added functionality.

SUMMARY OF THE INVENTION

According to one aspect of the present invention, a compact umbrella includes a hollow-cylindrical body forming a shell, wherein the shell is made of a solid material and is configured to accommodate the umbrella in a transport state of the umbrella, when the umbrella is closed and folded, as protective umbrella shell and to operate in an operating position of the umbrella, when opened, as a handle shell or carrying handle.

The aim is to build a compact umbrella with an additional further function element, like a shell—in particular a foldable collapsible umbrella with a hollow-cylindrical body forming an umbrella shell and handle shell or carrying handle. The cylindrical umbrella shell is used for both transporting the foldable collapsible umbrella and as a carrying handle for the umbrella in its operating position. In contrast to the above-mentioned publications, the umbrella shell and/the handle shell/carrying handle of the umbrella in the operating position are constructed as a single shell—and not a double shell.

According to an advantageous feature of the present invention, the foldable collapsible umbrella may have a known, commercially available canopy structure consisting of a telescopic main frame, an umbrella frame with a covering and canopy crown. The umbrella may have a connector located at the end of the main frame opposite the canopy crown, with the feature that the connector is, on the one hand, a support of a hollow-cylindrical body as an umbrella shell with an enclosed umbrella frame and covering and, on the other hand,—in a position rotated by 180°—is able to accommodate the hollow-cylindrical body as a handle shell/carrying handle with an exposed umbrella frame and covering—in the closed or open position of the umbrella.

According to another advantageous feature of the present invention, the preferably hollow-cylindrical handle shell/carrying handle may be designed so as to fully accommodate the umbrella consisting essentially of guide tube, support element, main frame, main and auxiliary slider, canopy crown, canopy frame and covering by folding and telescoping. Expedient handling by the user is provided by way of an easily accessible, preferably also circular pulling handle, which is finally integrally connected to the telescopic tube as an umbrella crown.

According to another advantageous feature of the present invention, after the umbrella has been used, the hollow-cylindrical body as a carrying handle may be removed from the connector and placed over the folded umbrella frame with covering with a slight twisting motion and again attached to the connector. At least the bottom of the hollow-cylindrical body may be provided with openings for the ventilation of the umbrella and for pressure equalization. Plastic and thin rolled metal—such as aluminum sheet metal, similar to the well-known beverage cans—is proposed as material for the hollow-cylindrical body. The connector accommodates the main frame as one piece; its material may also be plastic or metal. Important for the choice of material is the strength of the connection, mainly for the operation or use of the umbrella, to a lesser extent for transport. When the umbrella is opened, the connector must withstand in addition to the weight of the umbrella—also of a wet umbrella—also the wind load exerting pressure onto the umbrella. Particular attention must be paid to the design of the junction between the hollow-cylindrical body and the connector.

Advantageously, for accommodating the main frame, the connector may be provided with an opening or a blind hole or a through-hole, which is closed off after insertion of the main frame with a set screw or a pin in the radial direction perpendicular to the axial bore. Depending on the material used, the main frame and/or the guide tube may also be overmolded with plastic. It is planned to construct the main frame either secured against rotation or rotatable in relation to the connector. In the rotation-locked connection, the profile of the torsion-resistant main frame is polygonal—i.e. a polygon in cross-section. In the rotatable embodiment, the support element between the main frame and the guide tube is constructed as a rotary bearing.

In the following, the hollow-cylindrical body or shell for use as an umbrella sheath or as a handle shell/carrying handle is also referred to as a can, according to the working title "umbrella in the can." Because of the special importance of repeated long-term durability of the connector and the hollow-cylindrical body as a handle shell or carrying handle, various mechanical detachable connections are proposed that also depend on the materials used, such as 1. Conical clamping with silicone ring
2. Conical clamping with grooves and cusps
3. Metal can with grooves and cusps 4. Conical clamping with screw connection
5. Conical clamping with cam-rotation lock or twist-off screw closure
6. Connector-cam rotation lock or twist-off screw closure
7. Can-cam rotation lock or twist-off screw closure
8. Simple screw connection.

Regarding 1: Conical Clamping with Silicone Ring

With conical clamping, the can wall in the upper axial region is provided with an insertion taper of approximately 0.5° on the inside. Accordingly, the wall of the connector also receives such a conical taper in the axial direction which is designed so as to face away from the umbrella side and the effect of the fixed connection when introducing the connector into the can as a carrying handle is produced with a slight rotary motion. An additional silicone ring is inserted at the upper lateral edge of the connector facing the umbrella, which provides additional reinforcement of the connection by a friction fit. The releasable connection is detached by gently turning the can while simultaneously pulling the main frame or guide tube, respectively.

Regarding 2: Conical Clamping with Grooves and Cusps

In this clamping connection, the can wall and the connector wall each receive an insertion taper—similar to item 1 above. Furthermore, this clamping connection operates according to the "tongue-and-groove principle". The connector has at its top outer edge facing the umbrella a rounded groove, while the can as a handle shell/carrying handle has on the upper inner wall of its open side staggered elongated cusps that are spatially offset along the circumference, wherein after assembly of the can and the connector, the cusps are tightly guided inside the grooves. The can and the connector can be separated by gently twisting the can and connector relative to each other while at the same time exerting a pull between the two parts.

Regarding 3: Metal Can with Cone and Cusps

When the can as a handle shell/carrying handle in accordance with the clamping connection in item 2 is a metal can, the elongated cusps that are spatially circumferentially offset on the upper inside wall of its open side can be formed by a cylindrical plastic ring, which is placed with an exact fit over the inner wall of the can and has a bead on the upper end which fits over the sharp edge of the open side of the metal can, wherein this plastic ring assumes its position between inner wall of the can and the outer wall of the connector in the form of a press fit. Depending on the selected material, the plastic ring establishes a good friction fit between the smooth metal surface and the outer wall of the connector.

Regarding 4: Conical Clamping with Screw

In this clamping connection, the sleeve wall and the connector wall are each provided with an insertion taper—similar to item 1 above. In addition, the inside wall of the can has on its upper open end a non-continuous screw thread with a plurality of inputs, similar to a bayonet—closure. The connector has on its upper outer edge facing the umbrella also the non-continuous mating thread. The closure is done first by joining the sleeve and connector to the thread-free inputs of the screw connection, followed by twisting the sleeve and connector against each other until the shell and connector seat tightly. The release and separation of the connector is initiated by an opposite rotary motion. The respective rotation angle for attaching and releasing is each short and is only a quarter or third turn of a full circle. The rotation occurs against a stop—a lateral projection disposed on the outer wall—of the connector. Since the can is used as an umbrella shell and a carrying handle by way of a rotation of 180°, another similarly threaded assembly is mounted above the stop of the connector in the axial direction.

Regarding 5: Conical Clamping with Cam-Rotation Lock or Twist-Off Screw Closure

The cam-rotation lock or twist-off screw closure provides another solution for the closure of the can as a handle sleeve/carrying handle and the connector. With this clamping connection, the can wall and the connector wall each receive an insertion taper—similar to item 1 above. In addition, the inside wall of the can receives on its upper open end a plurality of staggered sloped edges which are fixed in position by friction by way of correspondingly arranged cusps on the outer wall of the connector after joining. The cusps which are spring-loaded after closing produce a particularly firm closure of the connected parts. The release and separation of the can and the connector is initiated by an opposite rotary motion. The respective rotation angle for fixing the position and for the release is each very short and is only a fraction of a full circle, The rotation occurs against a stop—a lateral projection on the outer wall—of the connector. Since the can is used as an umbrella shell and a carrying handle through a rotation of 180°, another similarly threaded assembly is mounted above the stop of the connector in the axial direction.

Regarding 6: Connector-Cam Rotation Lock or Twist-Off Screw Closure

Another embodiment of the closure of socket and connector is similar to item 5, with the difference that the chamfers under item 1 can be eliminated due to the tightness of the cam rotation lock or twist-off screw connection, making the connector flatter in the axial direction.

Regarding 7: Can-Cam Rotation Lock or Twist-Off Screw Closure

In another embodiment of the can/connector closure, it is proposed to reverse the retaining elements of the cam and the chamfers. The closure, similar to item 6 in form of a cam rotation lock or twist-off screw closure, is established in that the upper open edge of the can carries on its inner side the cams disposed along the periphery, while the connector has the circumferential chamfers. Locking also occurs against a stop on the peripheral wall of the connector; the chamfers are formed on either side of the stop as mirror images.

Regarding 8: Simple Screw Connection

According to another advantageous embodiment of the can/connector closure, the strong detachable connection is formed by double-sided screw threads. For this purpose, the upper open inner wall of the can has several thread turns, while the connector with a stop on the outer wall also has corresponding thread turns. For bilateral use of the can as an umbrella shell and a handle shell/carrying handle, the connector has another equivalent thread configured as a mirror image in relation to the stop in the axial direction. The design of the thread regarding the number and the angle of the slope of the tapers is, among other things, dependent on the material; the angle of rotation for locking or releasing the connection is at any rate many times greater than that of the cam rotation or twist-off screw closure.

Another advantage of the design of the folding collapsible umbrella with a can handle is the ergonomic and advertising-friendly design of the umbrella shell; the preferably hollow-cylindrical construction of the plastic or metal body rests comfortably in the hand of the user, gives the carrier a special sense of value due to the high quality of the employed materials, and provides an ideal advertising space even when the umbrella covering is not open.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
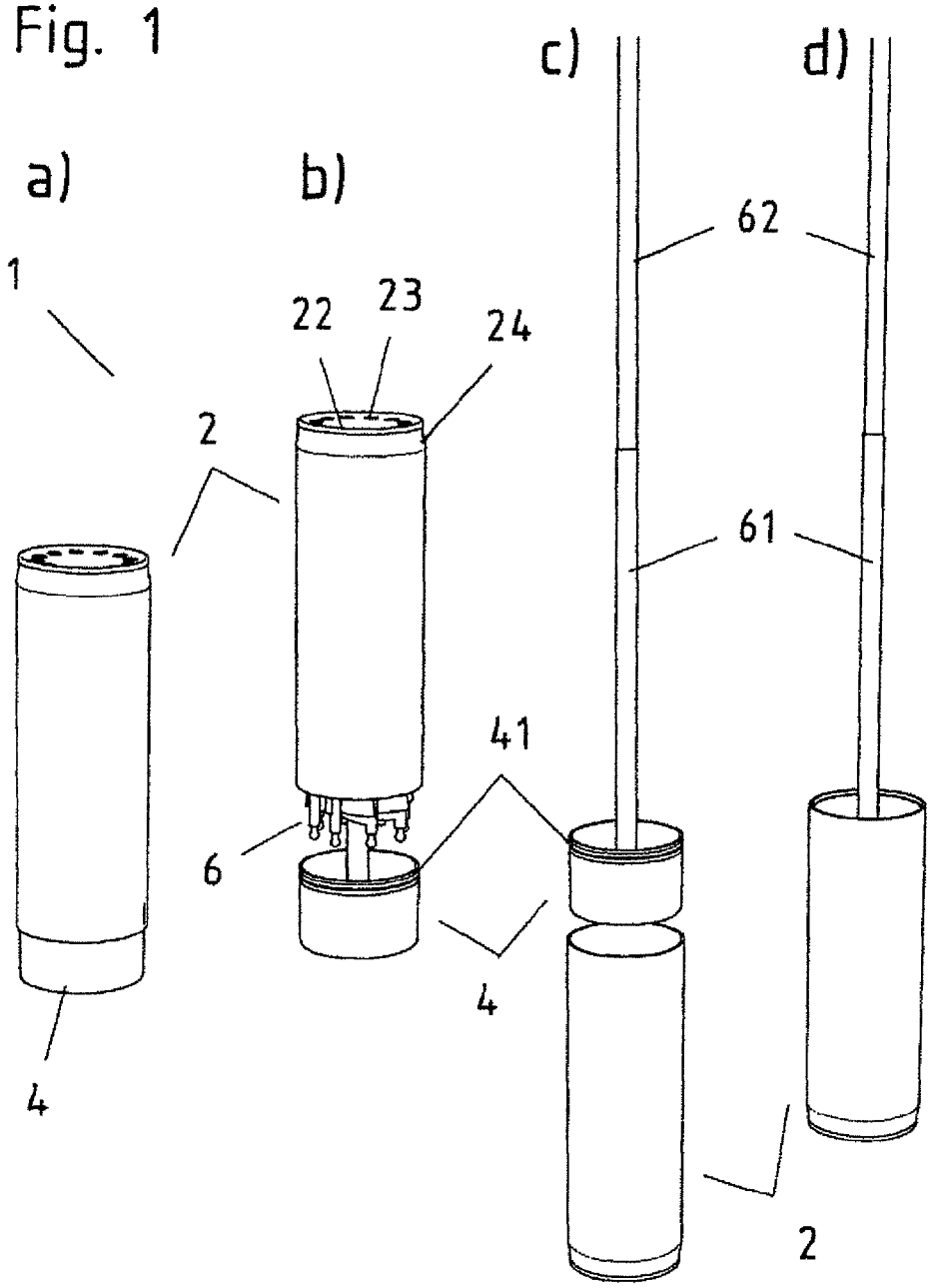
FIG. 1 shows a collapsible umbrella according to the present invention during handling a) in the transport state with umbrella shell b) with the umbrella shell, open c) with the umbrella shell removed, umbrella extended d) in the operating position with handle shell or carrying handle

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Turning now to the drawing, FIG. 1 shows handling of the collapsible umbrella 1, in FIG. 1*a*) screwed in the transport state with umbrella shell 2 and connector 4 screwed together, in FIG. 1*b*) with opened umbrella shell 2 with still visible canopy 6 and unscrewed connector 4, in FIG. 1*c*) with removed umbrella shell 2, axially rotated by 180° and pulled-out umbrella, illustrated by the guide tube 61, the main frame 62 and the connector 4, wherein the canopy frame and the covering as part of the canopy of the umbrella are not shown here, and in FIG. 1*d*) the umbrella 1 in the operating position with the handle shell or carrying handle 2 screwed on the connector 4. Handle shell/carrying handle and connector are in the illustrated example screwed together (not shown) via an (unillustrated) internal thread 21/external thread 41, which is certainly a possible releasable connection. The figures show in the umbrella shell, or the handle shell/carrying handle the stepped rim 24 with a reduced diameter like in beverage cans. The bottom 22 of the umbrella shell or the handle shell/carrying handle 2 is like the bottom 47 of the connector 4 (not shown) provided with a plurality of apertures or bores 23, 43 (not shown); these are provided for ventilation and pressure equalizing of, for example, a damp or wet canopy in the umbrella shell. As can be seen particularly in FIG. 1*d*), the releasable connection between handle shell/carrying handle and connector is of particular importance; the connection must, on the one hand, accommodate the weight of the umbrella—even of a damp or wet umbrella—take and, on the other hand, absorb the wind loads incident on the open umbrella without damaging the connections. For this reason, various types of possible durable, detachable connections are shown below.

Figure 2:
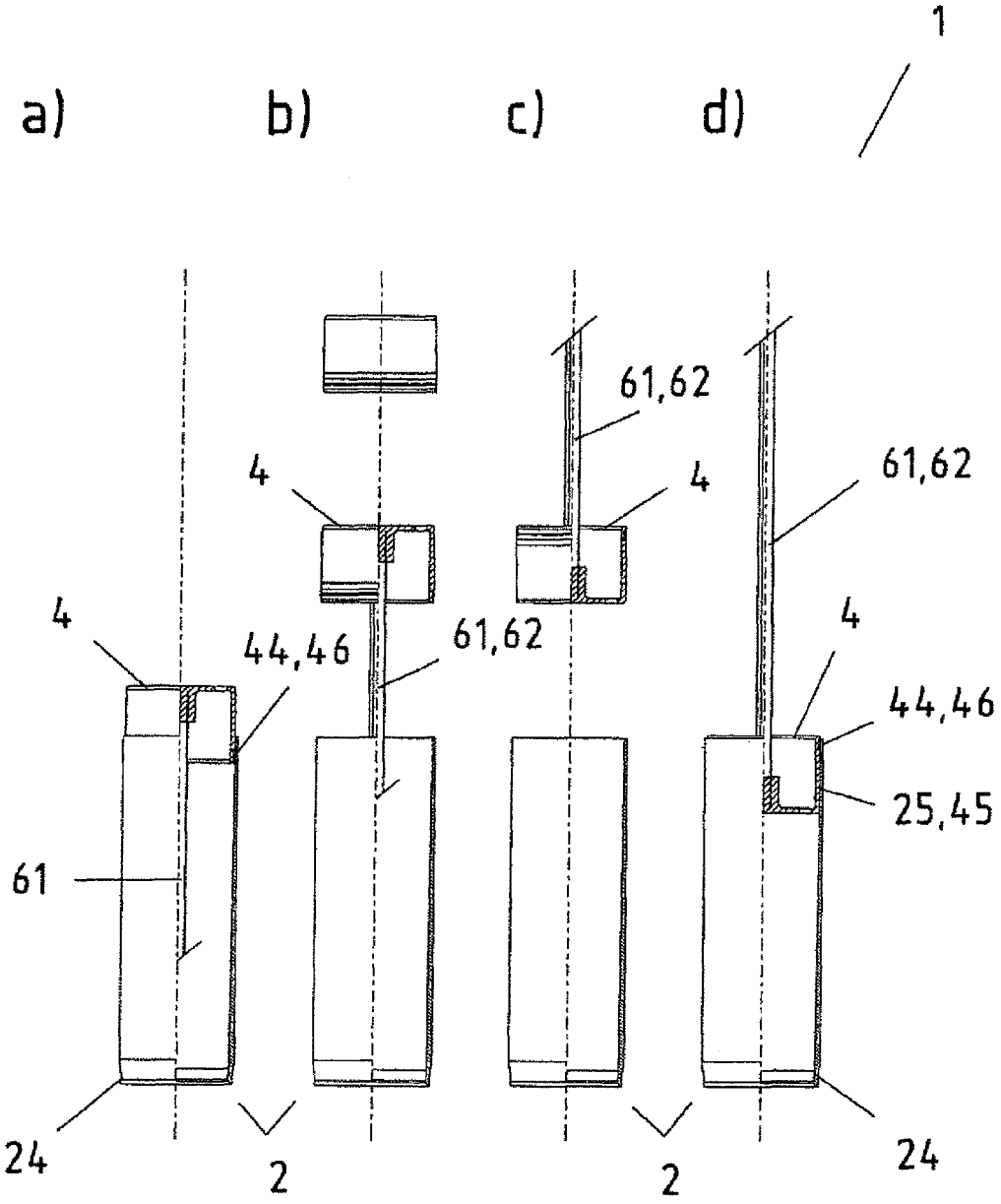
FIG. 2 shows a collapsible umbrella with conical clamping and silicone ring, in half-section, in the states a) . . . d) and in the e) transport state f) operating position
Figure 2:
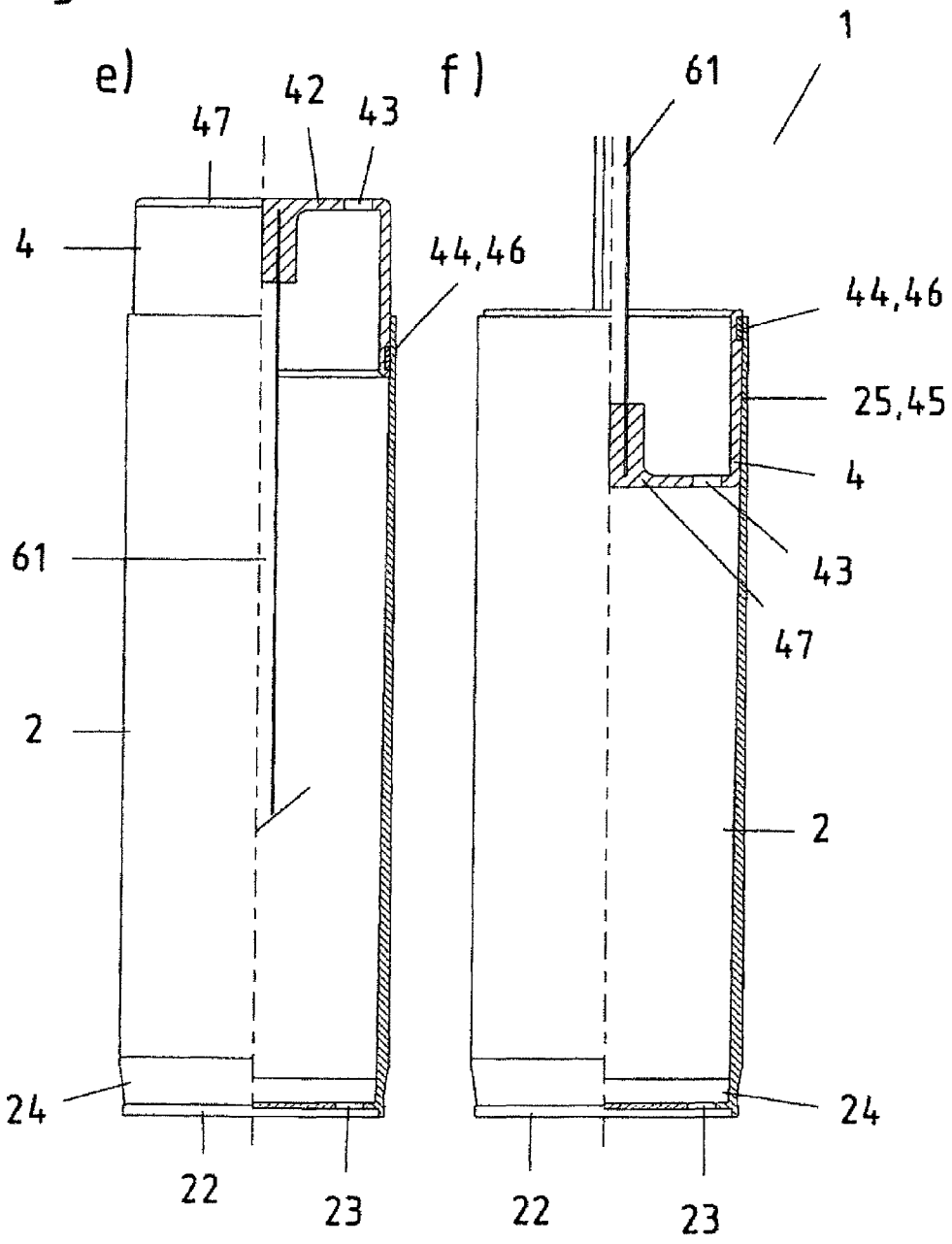

FIG. 2 shows the various states of the foldable collapsible umbrella of FIG. 1 in half-section. FIG. 2*a*) shows the folded packaged umbrella, FIG. 2*b*) the umbrella with partially open connector 4, FIG. 2*c*) the distal umbrella shell 2 axially rotated by 180°, and FIG. 2*d*) the open umbrella with the umbrella shell as a handle shell or carrying handle 2. The hollow-cylindrical connecting surface 25 of the umbrella shell 2 is slightly conically expanded toward the shell opening by approximately 0.5° and likewise the outer surface 45 of the connector 4, also toward the canopy, resulting in a very good interference fit after insertion of the handle shell/carrying handle and the connector. The connector has on its upper edge facing the canopy of the outer surface 45 a circumferential (360°) external groove 44 which is filled with a silicone ring 46, enhancing the strength and stability of the detachable connection of the handle shell/support handle and connector due to the increased friction.

FIG. 2*e*) illustrates in an enlarged scale the transport state of the foldable collapsible umbrella 1 and FIG. 2*f*) the operating position. The design of the connection of umbrella shell and handle shell/carrying handle 2 and connector 3—as above—is illustrated.

Figure 3:
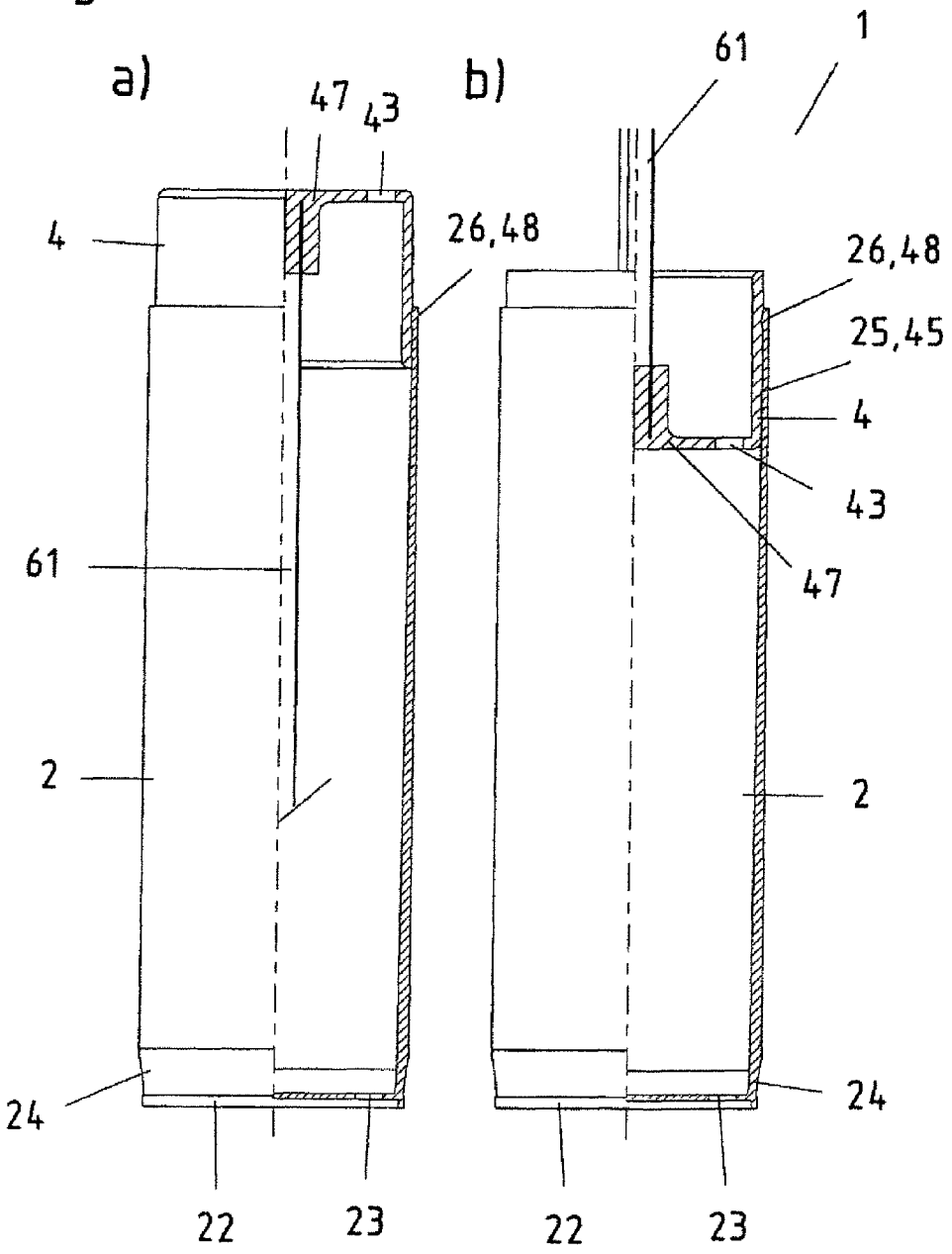
FIG. 3 shows a collapsible umbrella with conical clamping, groove and cusps, in half-section, in the a) transport state b) operating position

FIG. 3 shows in half-section another variant of the design of the connection of umbrella shell and handle shell/carrying handle 2 and the connector 4 of the collapsible umbrella 1, namely the foldable collapsible umbrella 1 with conical clamping, groove and cusps, in FIG. 3*a*) in the transport state and in FIG. 3*b*) in the operating position. The design of the connection corresponds to that of the preceding arrangement, as far as the structure and the purpose of the conical surfaces 25, 45 are concerned. The locking function is here released with an external circumferential groove 48 at the top edge of the connector 4 which is open toward the canopy and an interior peripheral cusp 26 on the upper edge of the open handle shell/carrying handle 2. The handle shell/carrying handle is now slipped over the connector when the umbrella is open and the cusp is urged to latch in the groove through a slight rotation and compression.

Figure 4:
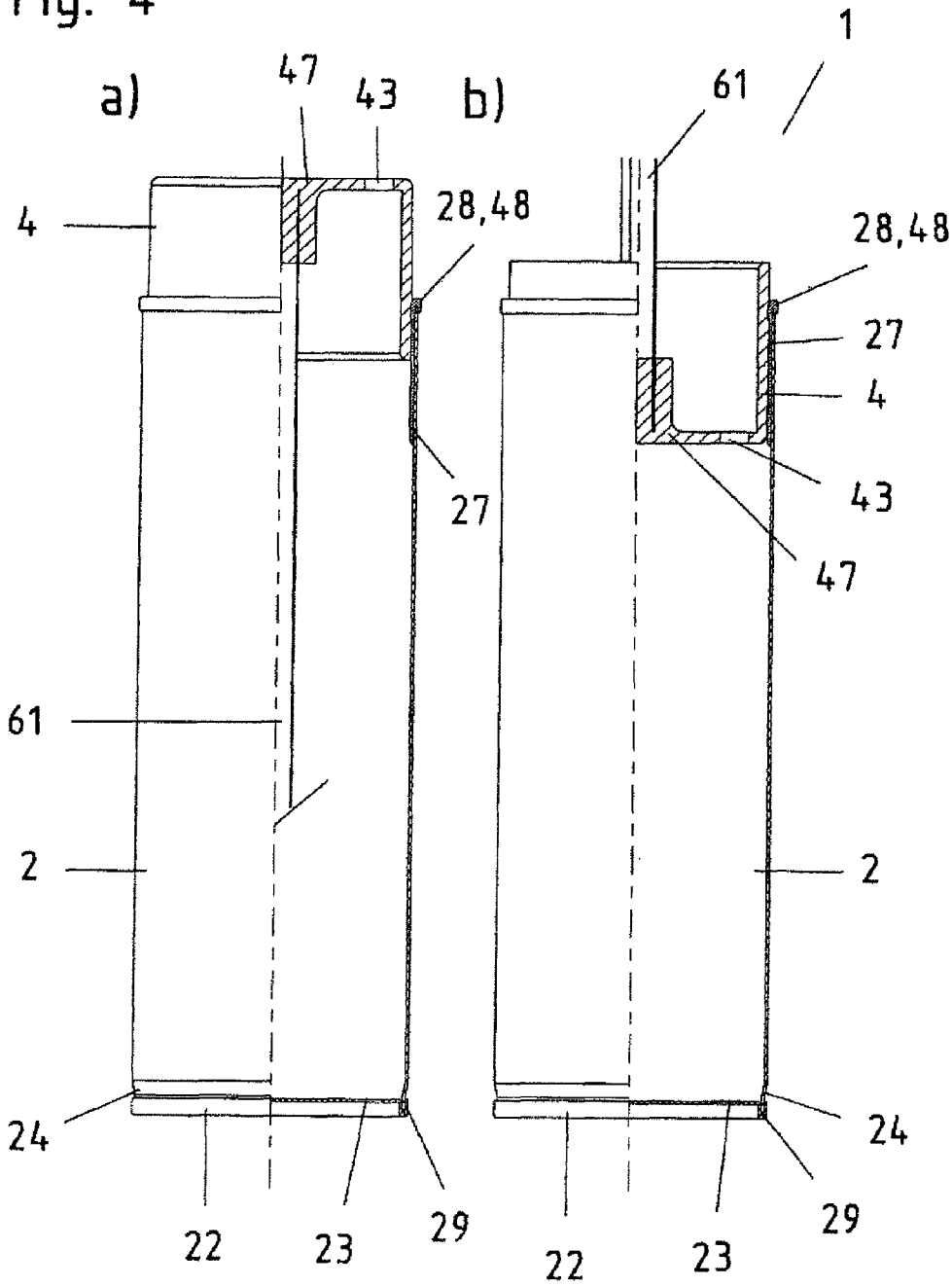
FIG. 4 shows a collapsible umbrella with metal can, cone, ring and cusps, in half-section, in the a) transport state b) operating position

FIG. 4 shows the foldable collapsible umbrella 1 in the metal can 2 with a cone, a plastic ring 27 and cusps 28 in half section; FIG. 4*a*) in the transport state with the umbrella closed, and FIG. 4*b*) in the operating position with the umbrella open. The metal can also have the characteristic features of a beverage can; see also the offset lower edge 24. The bottom plate 22 which also has openings 23 is made of a circular stamped/bent component, wherein edges pointing outward at right angles in relation to the bottom are pressed against the offset lower edge of the can wall, forming a stabilizing and sealing fold 29. The other edge at the top end of the can facing the fold is covered with an interior plastic ring 27—inserted and pressed in as a finished part or injection-molded in the metal can—which forms a circumferential bead 28 around the edge of the can, locking inside the radially circumferential groove 48 of the connector 4 and fixedly securing the press fit of the connector in the metal can both in the transport state and in the operating position; the plastic ring 27 operates in this configuration like an expansion anchor.

Figure 5:
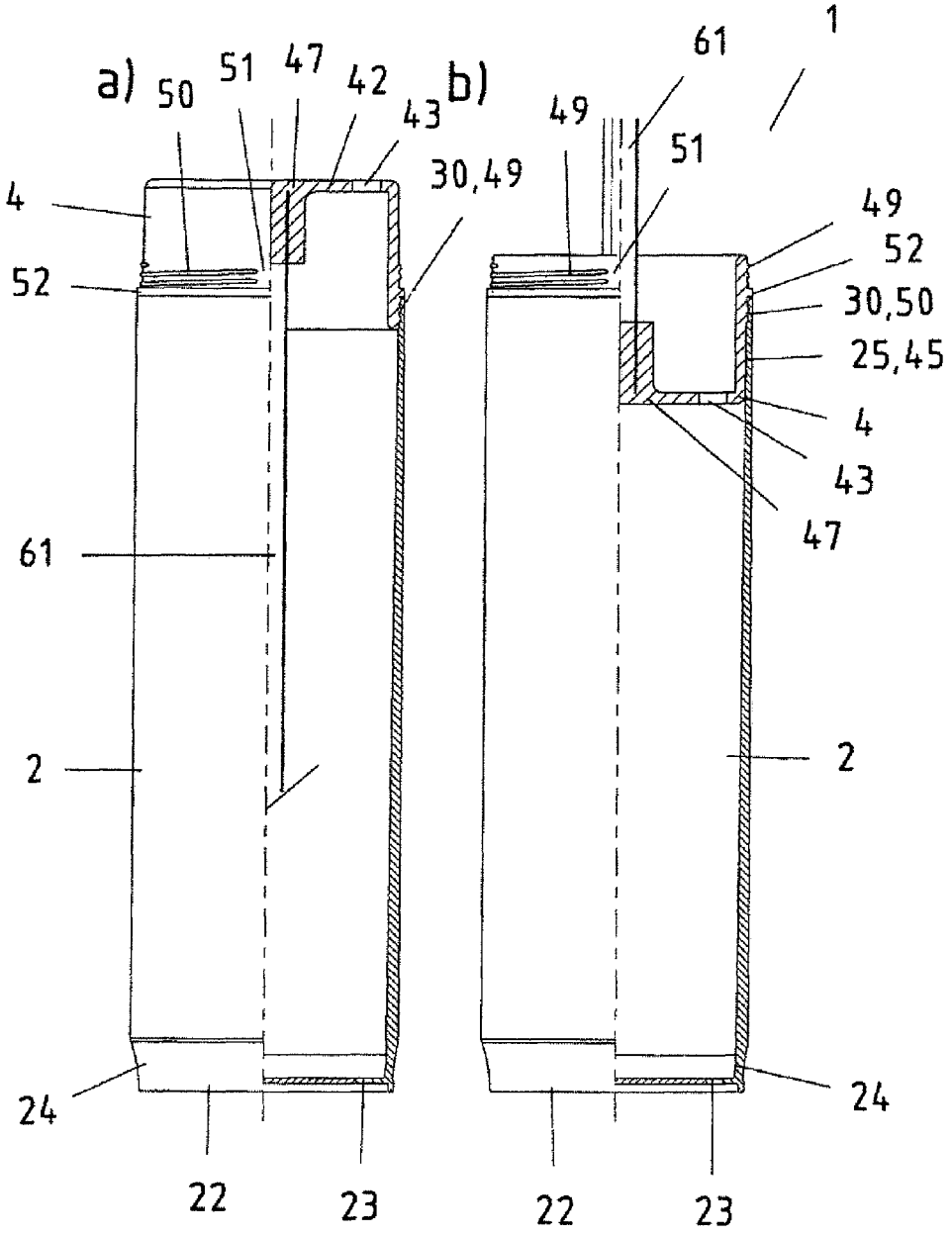
FIG. 5 shows a collapsible umbrella with conical clamping and screw connection, in half-section, in the a) transport state b) operating position

FIG. 5 shows the foldable collapsible umbrella 1 with conical clamping and screw connection in half section; FIG. 5*a*) in the transport state with the umbrella closed; and FIG. 5*b*) in operating position with the umbrella open. With this clamp connection, the shell wall 2 and the connector wall 4 each have an insertion taper 25, 45. In addition, the inner wall of the shell has at its upper open end a non-continuous screw thread 30 with a plurality of inputs 31, similar to a bayonet lock. The connector 4 has at its top outer edge facing the umbrella 1 also a corresponding non-continuous thread 1 49 with inputs 51. The closure is performed initially by joining shell and connector on the unthreaded inputs 31, 51 of the screw connection 30, 49, followed by twisting against each other until a tight fit between shell and connector is achieved. Release and separation of the shell and connector is initiated by rotation in the opposite direction. The respective rotation angle for locking and releasing is short and is only a quarter-turn or a third-turn of a full circle. The rotation occurs against a stop 52—a lateral, radially directed projection on the outer wall—of the connector 4. Since the can 2 is used as an umbrella shell and with an axial rotation of 180° as a handle shell/carrying handle, another similar thread arrangement 2 50, 51 is mounted above the stop of the connector in the axial direction, which represents in addition to the conical clamping 25, 45 a fixed screw connection 30, 50 for the umbrella in the operating position.

Figure 6:
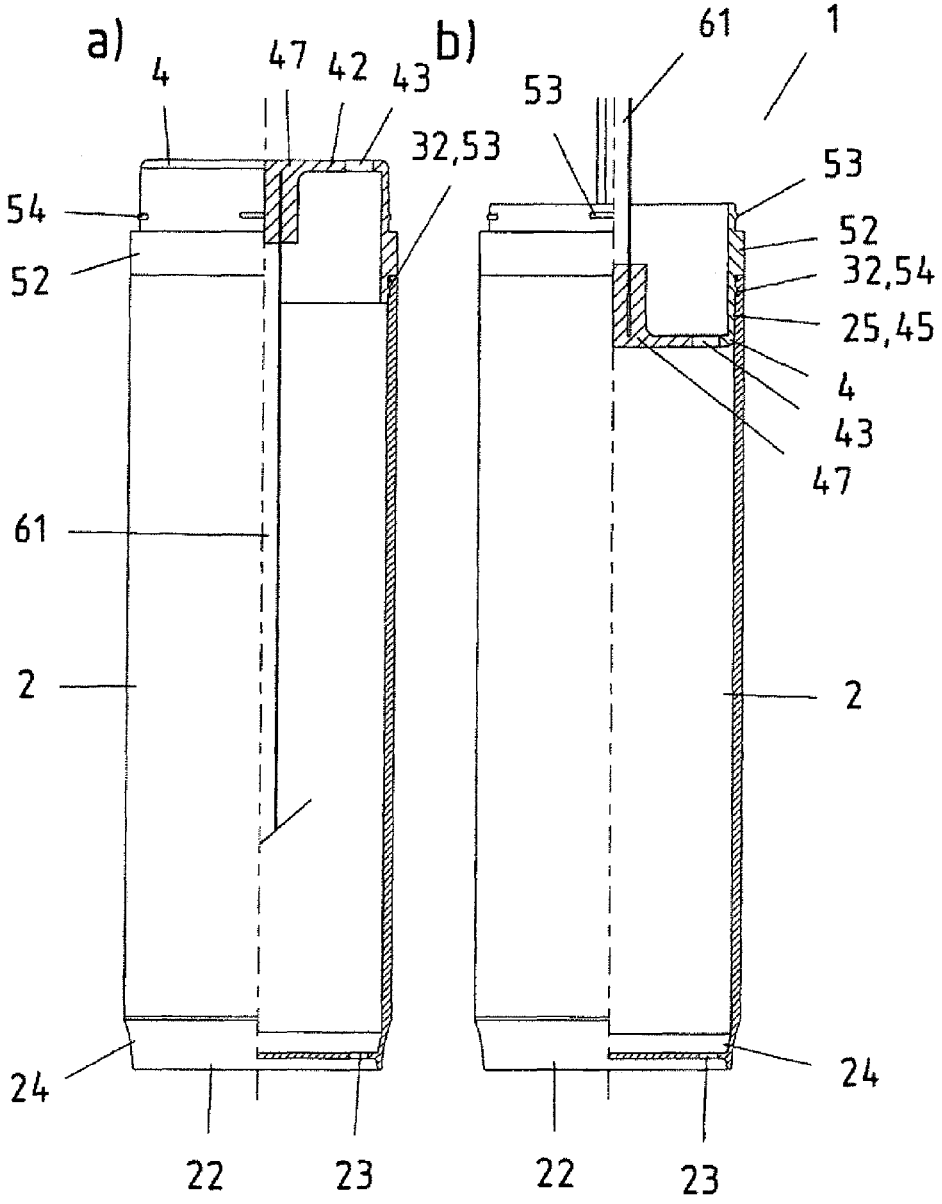
FIG. 6 shows a collapsible umbrella with conical clamping, and cam rotation/twist-off screw closure, in half-section, in the a) transport state b) operating position

FIG. 6 shows the collapsible umbrella 1 with conical clamping and cam rotation/twist-off screw closure in half section; FIG. 6*a*) in the transport state with the umbrella closed and folded; and FIG. 6*b*) in the operating position with the umbrella open. The cam rotation or twist-off screw closure represents another solution for the closure of can as a handle shell/carrying handle 2 and the connector 4. With this clamping connection, the shell wall and the connector wall each have an insertion taper 25, 45—as described under item 1. In addition, the inner wall of the shell has at its upper open end of a plurality of circumferentially offset chamfers 32, which are fixed by suitably arranged cams 53 on the exterior wall of the connector after insertion by a friction fit. The cams 53 which are spring-loaded after closing provide a particularly firm lock between the connected parts. The release and separation of the shell 2 and the connector 4 are initiated through rotation in the opposite direction. The respective rotation angle for locking and releasing is each very short and is only a fraction of a full circle. The rotation occurs against a stop 52—a lateral projection on the outer wall—of the connector 4. Since the shell 2 is used as an umbrella shell and after a rotation by 180° as a handle shell/carrying handle, a similar cam assembly 32, 54 is mounted above the stop of the connector in the axial direction.

Figure 7:
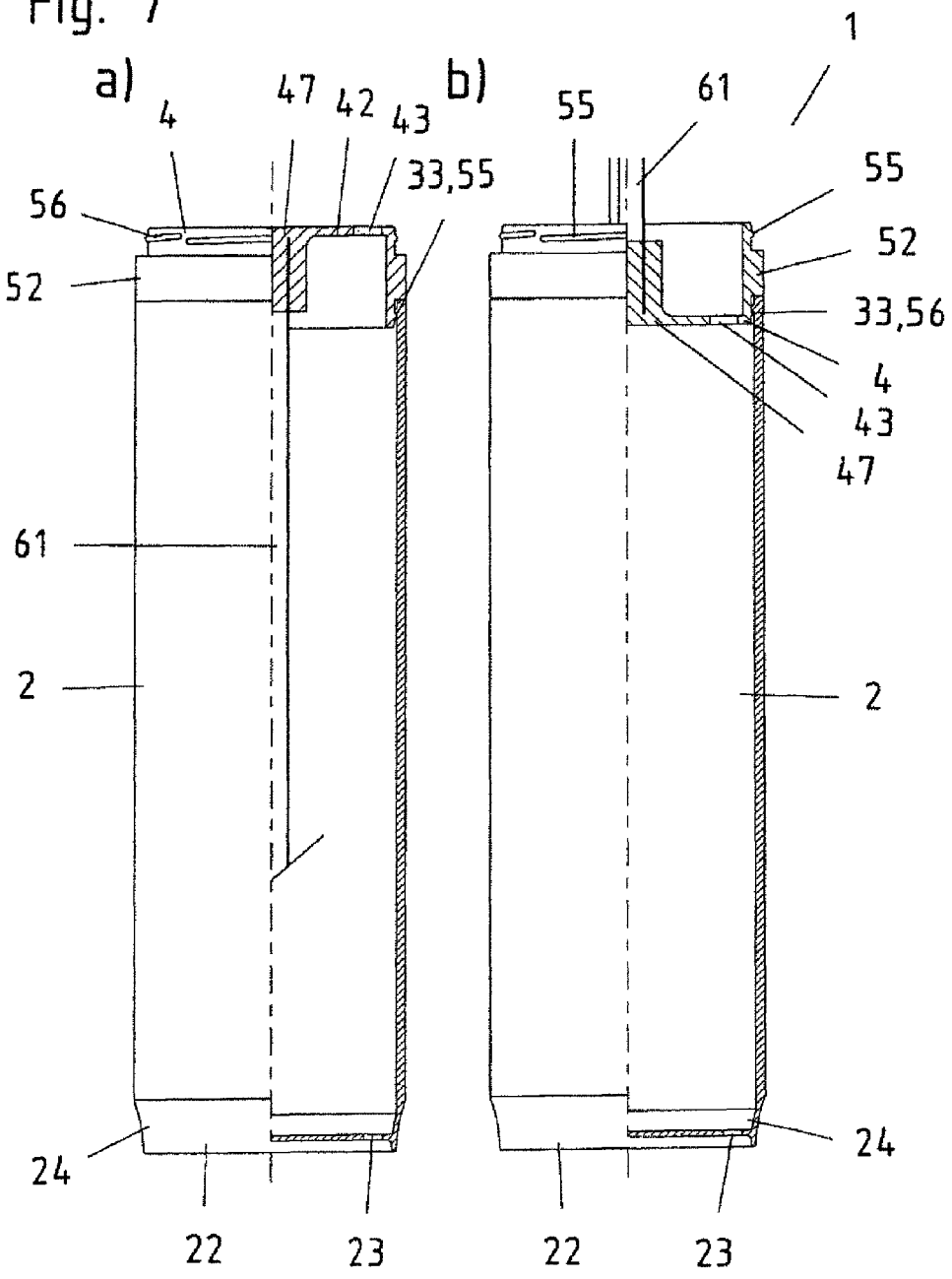
FIG. 7 shows a collapsible umbrella with cam rotation/twist-off screw closure, in half-section, with a a) connector with chamfers, transport state b) connector with chamfers, operating position

FIG. 7 shows the collapsible umbrella 1 with cam rotation/twist-off screw closure in half-section; in FIG. 7*a*) the umbrella is shown in the transport state, the connector 4 has the chamfers 55, 56 and the shell 2 has the cams 33; and in FIG. 7*b*) the collapsible umbrella case is shown in the operating position; the chamfer 56 of the connector engages non-positively with the cam 33 of the shell. In this embodiment of the cam rotation/twist-off screw closure, it is proposed to reverse the holding elements composed of the cam and chamfers. The closure—similar item 6, a cam rotation lock or twist-off screw closure—is constructed so that the upper open edge of the shell 2 has circumferentially arranged cams 33 on its inner side, while the connector 4 has the peripheral chamfers 55, 56. Locking takes place against a radially spaced stop 52 on the peripheral wall of the connector; the chamfers are arranged on both sides of the stop in the axial direction, forming a mirror image with respect to the radius.

Figure 8:
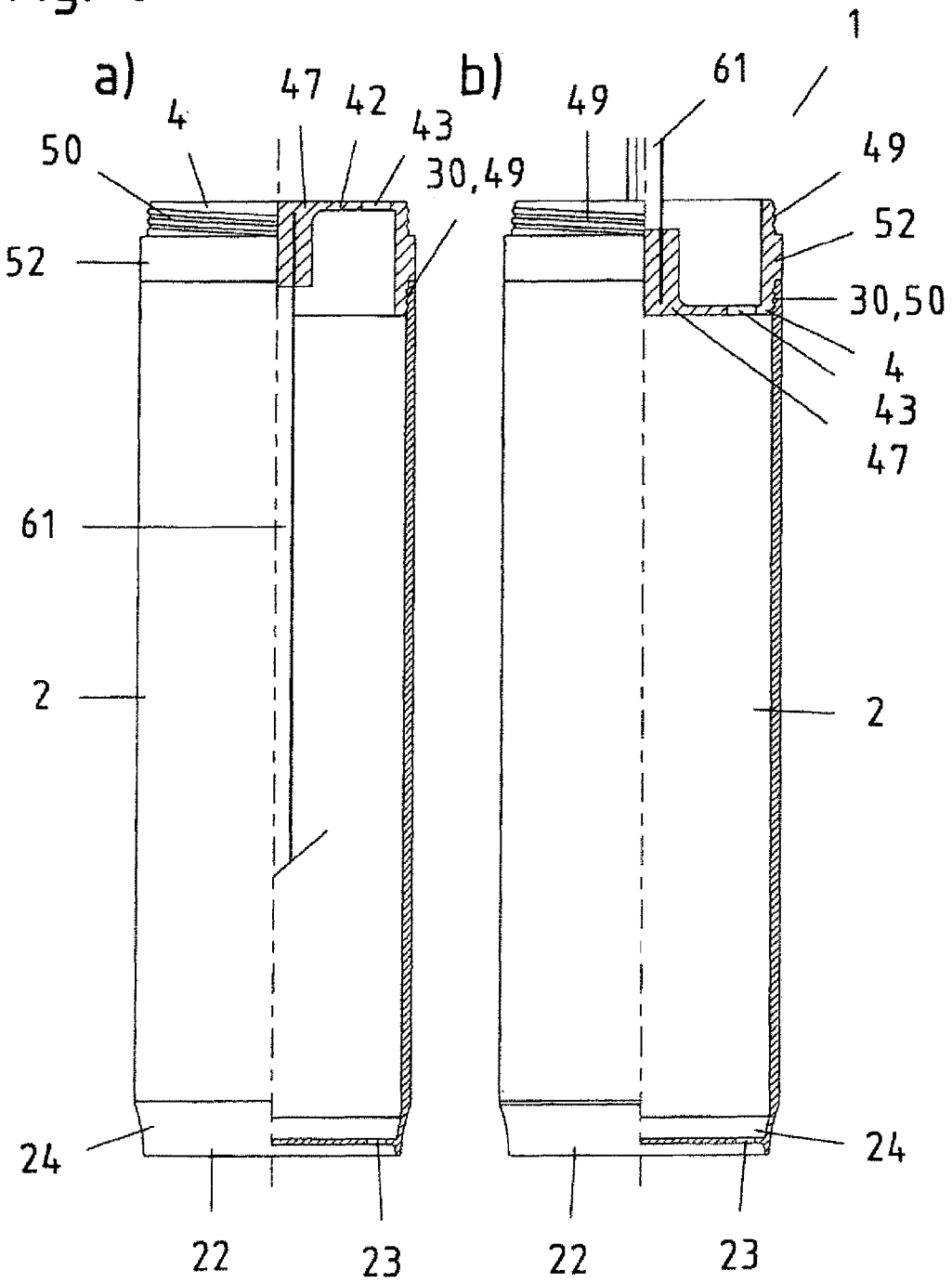
FIG. 8 shows a collapsible umbrella with screw connection, in half-section, in the a) transport state b) operating position

FIG. 8 depicts once more in half section the collapsible umbrella 1 with a screw connection between the shell 2 and the connector 4, in FIG. 8*a*) the umbrella in the closed transport state and in FIG. 8*b*) in the open state in the operating position. According to a further embodiment of the shell/connector closure of a collapsible umbrella, the strong detachable connection is formed by double-sided screw threads 30, 49. For this purpose, the upper inner wall of the shell which is open at the top has several thread turns 30 and the connector which is provided with a stop on the outer wall also has corresponding thread turns 49. For a combined use of the shell 2 as an umbrella shell and as a handle shell/carrying handle, the connector 4 has an additional equivalent thread 50 which is mirrored on the stop 52 in the axial direction. The design of the thread regarding the depth and the number and angle of the slopes depend, among other things, on the material; the angle of rotation for locking or releasing the connection is at any rate many times greater than that of the cam rotation or twist-off screw closure. Because the additional conical shape of the inner surface of the shell and of the outer surface of the connector is eliminated, the connector is correspondingly flatter in the axial direction.

The advantages achieved with the invention are, in particular, that only a single hollow-cylindrical component is used for the packaging of a folding collapsible umbrella in the transport state and the use of the umbrella by means of a handle shell/carrying handle. Some examples are proposed for possible assembly and interconnection techniques for the strong detachable connection of shell and connector; other connections—like a bayonet closure with snap-in or latching—can also be considered. Depending on the design of the strong detachable connection, other non-cylindrical or part-cylindrical or semi-cylindrical shapes for the case for the shell forms may be contemplated. The most advantageous connection technology is based on fast handling by the user along with a lasting and sufficient strength of shell and connector—even under adverse climatic conditions, such as high wind loads in conjunction with wetness.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A compact umbrella comprising a hollow-cylindrical body forming a shell, wherein the shell is made of a solid material and is configured to accommodate the umbrella in a transport state of the umbrella, when the umbrella is closed and folded, as protective umbrella shell and to operate in an operating position of the umbrella, when opened, as a handle shell or carrying handle; and a connector connectable with the shell in the transport state of the umbrella and also connectable with the shell in the operating position of the umbrella;

wherein the shell has a shell bottom and the connector has a connector bottom such that in the transport state of the umbrella the shell bottom and the connector bottom are located opposite to one another at a first distance, and in the operating position of the umbrella, the shell bottom and connector bottom are spaced apart at a second distance, the second distance being less than the first distance;

wherein the shell bottom has a first plurality of apertures arranged therein and the connector bottom has a second plurality of apertures arranged therein, and the first and second plurality of apertures are located opposite to one another in the transport state of the umbrella, so that when the umbrella is closed and folded and accommodated in the shell, ventilation and pressure equalization is provided inside the shell by the apertures in the shell bottom and the connector bottom.

2. The compact umbrella of claim 1, wherein the umbrella is a foldable collapsible umbrella.

3. The compact umbrella of claim 1, wherein the connector has a finite radial projection extending beyond the periphery, which serves as a mechanical stop for an edge disposed on an open side of the shell.

4. The compact umbrella of claim 3, wherein a radially outwardly facing cylindrical surface of the connector has in the axial direction both above and below the stop a respective continuous or non-continuous thread, which cooperates with a thread disposed on an upper edge of an open side of the shell on a radially inwardly facing surface of the shell, so that the shell always advances in the axial direction when screwed in radially, with the non-continuous thread allowing the shell and connector to be connected by insertion before forming a shortened screw connection.

5. The compact umbrella of claim 1, wherein surfaces of the shell operating as the handle shell or the carrying handle and of the connector that face each other in the operating position of the umbrella are shaped as truncated cones, with a larger diameter of the truncated cones facing the umbrella, wherein upon mating of the shell and the connector the surfaces form an interference fit.

6. The compact umbrella of claim 1, wherein the connector has a radially outwardly facing surface with a groove configured to accommodate a friction ring.

7. The compact umbrella of claim 1, wherein the connector has a radially outwardly facing surface with a groove configured to accommodate in the operating position of the umbrella a radially encircling bead disposed on the shell.

8. The compact umbrella of claim 1, wherein in the operating position of the umbrella, a hollow-cylindrical friction ring encircles an edge of an open side of the shell and is arranged between a radially outwardly facing surface of the connector having a groove and a corresponding, inwardly facing surface disposed at an axial height of an open side of the shell to provide a stronger connection between the shell and the connector, with a lateral bead of the friction ring being disposed inside the groove for additionally stabilizing the connection.

* * * * *